US005528128A

United States Patent [19]

Melse

[11] Patent Number: 5,528,128

[45] Date of Patent: Jun. 18, 1996

[54] REFERENCE VOLTAGE SOURCE FOR BIASSING A PLURALITY OF CURRENT SOURCE TRANSISTORS WITH TEMPERATURE-COMPENSATED CURRENT SUPPLY

[75] Inventor: Abraham L. Melse, Nijmegen, Netherlands

[73] Assignee: U.S. Philips Corporation, New York, N.Y.

[21] Appl. No.: 414,665

[22] Filed: Mar. 31, 1995

[30] Foreign Application Priority Data

Apr. 8, 1994 [EP] European Pat. Off. ..... 94200962

[51] Int. Cl.[6] ..... G05F 3/16

[52] U.S. Cl. ..... 323/313; 323/315

[58] Field of Search ..... 323/313, 314, 323/315, 316, 317; 330/252, 257, 288; 327/535, 538, 539

[56] References Cited

U.S. PATENT DOCUMENTS

| | | | |
|---|---|---|---|
| 4,059,793 | 11/1977 | Ahmed | 323/19 |
| 4,100,436 | 7/1978 | Van De Plassche | 307/296 |
| 4,230,999 | 10/1980 | Ahmed | 330/288 |
| 4,270,101 | 5/1981 | Ahmed | 331/111 |
| 4,590,418 | 5/1986 | Moriarty, Jr. | 323/313 |
| 4,816,742 | 3/1989 | Van De Plassche | 323/314 |
| 5,229,711 | 7/1993 | Inoue | 323/313 |
| 5,239,256 | 8/1993 | Yoshida | 323/313 |

FOREIGN PATENT DOCUMENTS 0252320 1/1988 European Pat. Off. ..... G05F 3/30

OTHER PUBLICATIONS

"A Precision Reference Voltage Source" by Karel E. Kuijk, IEEE Journal of Solid–State Circuits, vol SC–8, No. 3, Jun. 1973, pp. 222–226.

"New Developments in IC Voltage Regulators" by Robert J. Widlar, reprinted from IEEE Journal Solid–State Circuits, vol. SC–6, pp. 2–7, Feb. 1971, pp. 150–155.

*Primary Examiner*—Matthew V. Nguyen
*Attorney, Agent, or Firm*—Bernard Franzblau

[57] ABSTRACT

A reference voltage source for driving a constant-current source. The reference voltage source comprises a first common terminal, a second common terminal, a first connection terminal, and a second connection terminal. A first semiconductor junction device and a first resistor are connected in series between the first connection terminal and the second common terminal. A second resistor is connected between the first common terminal and the second connection terminal and a second semiconductor junction device is connected between the second connection terminal and the second common terminal. A third semiconductor junction device is connected between the first common terminal and the first connection terminal. A differential amplifier has an output and an inverting input and a non-inverting input. One input is coupled to the first connection terminal and the other input is coupled to the second connection terminal and one of the first and second common terminals is coupled to the output of the differential amplifier. The temperature coefficient of the sum current ($I_1+I_2$) can be made zero. The sum current is mirrored to current source transistors which supply a temperature stable current.

19 Claims, 7 Drawing Sheets

REFERENCE VOLTAGE SOURCE FOR BIASSING A PLURALITY OF CURRENT SOURCE TRANSISTORS WITH TEMPERATURE-COMPENSATED CURRENT SUPPLY

BACKGROUND OF THE INVENTION

This invention relates to a reference voltage source for driving a current source, which reference voltage source comprises:

- a first common terminal, a second common terminal, a first connection terminal, and a second connection terminal;
- an impedance connected between the first common terminal and the first connection terminal;
- a first semiconductor junction and a first resistor, connected in series between the first connection terminal and the second common terminal;
- a second resistor connected between the first common terminal and the second connection terminal;
- a second semiconductor junction connected between the second connection terminal and the second common terminal;
- a differential amplifier having an output and having an inverting input and a non-inverting input, wherein one of the inputs is coupled to the first connection terminal and the other input is coupled to the second connection terminal; and
- one of the first and second common terminals is coupled to the output of the differential amplifier and the other one is coupled to a first supply terminal.

A reference voltage source of this type is disclosed in U.S. Pat. No. 4,100,436 and is known as a band-gap reference voltage source. The impedance used therein takes the form of a resistor. The output of the differential amplifier is connected to the first common terminal and the second common terminal is connected to ground. The differential amplifier imposes a constant ratio upon the currents through the first and the second semiconductor junction. The current ratio is determined by the ratio between the resistance values of the resistance of the impedance and the second resistor. The difference between the junction voltages of the first and the second semiconductor junction, which difference has a positive temperature coefficient (TC), appears across the first resistor. Consequently, the current through the first resistor also has a positive TC. This current flows through the resistance of the impedance and produces across this resistance a voltage which also has a positive TC. The differential amplifier ensures that the voltage difference between the first and the second connection terminal is negligible, so that the voltage across the resistance of the impedance between the first connection terminal and the first common terminal is equal to the voltage across the second resistor connected between the second connection terminal and the first common terminal. The output voltage at the output of the differential amplifier is the sum of the junction voltage of the second semiconductor junction and the voltage across the second resistor. As is known, the voltage across a semiconductor junction has a negative TC. In the case of suitably selected parameters the sum of the voltages across the second resistor and the second semiconductor junction has a TC of substantially zero over a wide temperature range. This sum voltage is available for further purposes at the output of the differential amplifier.

Said U.S. Pat. No. 4,100,436 discloses a variant in which both the first and the second semiconductor junction comprise diode-connected transistors. U.S. Pat. No. 4,059,793, FIG. 2 and FIG. 3, shows a second variant, in which the first semiconductor junction is the base-emitter junction of a transistor having its collector connected to the first connection terminal and having its emitter connected to the first supply terminal via the first resistor, and in which the second semiconductor junction is the base-emitter junction of a transistor having its base coupled to the base of the first-mentioned transistor and having its collector connected to the second connection terminal. In principle, this second variant is a form of the Widlar band-gap reference published in IEEE Journal of Solid-State Circuits, Vol. SC-6, No. 1, pp. 2–7, February 1971, "New Developments in IC Voltage Regulators", FIG. 2.

Integrated circuits often require not only a thermally very stable reference voltage but also one or more temperature-stable reference currents. Such reference currents are supplied by transistors arranged as current sources, with or without an emitter series resistor. The bases of the current source transistors receive a reference, which is converted into a current. However, the magnitude of the current is also determined by the base-emitter junction voltage of the current source transistors, which voltage, as is known, has a negative TC and consequently requires a correction in order to obtain a temperature-stable current.

U.S. Pat. No. 4,816,742 reveals a solution in which the negative TC of the emitter current of the current source transistor is compensated by arranging a compensation current source with a positive TC in parallel with the emitter series resistor, resulting in a zero TC of the net collector current of the current source transistor. However, this solution is less attractive owing to the additional components and the resulting additional chip area. Indeed, each current source transistor requires a compensation transistor and, in addition, a conductor is needed to drive all these compensation transistors.

European Patent Specification 0,252,320 B1 reveals another solution, for which a resistor is connected in parallel with the second semiconductor junction. A current with a negative TC then flows through this resistor and compensates for the negative TC of the base-emitter junctions of the connected current source transistors. However, this solution is used in a reference voltage source of another type than described hereinbefore, i.e. of the Brokaw band-gap reference type. In this type the first and second semiconductor junctions are base-emitter junctions of transistors whose collectors are connected to the first and the second connection terminal and whose bases are connected to the output of the differential amplifier, the sum of the emitter currents of the transistors being formed in a common resistor.

SUMMARY OF THE INVENTION

It is an object of the present invention to provide a reference voltage source for driving current source transistors, which is corrected for the thermal behaviour of the base-emitter junctions of the current source transistors.

To this end, in accordance with the invention, a reference voltage source of the type defined in the opening paragraph is characterised in that the impedance comprises a third semiconductor junction.

Since the differential amplifier makes the voltage difference between the first and the second connection terminal substantially zero, the second connection terminal may be regarded as the input terminal of a first current mirror formed by the first semiconductor junction, the first resistor and the second semiconductor junction, the output terminal of this current mirror being formed by the first connection terminal. The first current mirror has a current transfer with a positive TC caused by the junction voltage difference across the first resistor. The construction with the differential amplifier, the second resistor and the third semiconductor junction imposes a given ratio upon the currents through the first and the second semiconductor junction. In fact, this construction functions as a second current mirror whose current transfer has a negative TC. The combination of the two current mirrors results in a multiplication of two opposed temperature coefficients, the sum of the currents in the first or the second common terminal having a TC whose sign and value can be adjusted by an appropriate choice of the first and the second resistor and of the current density ratio in the first and the second semiconductor junction. This choice can be made easier when a third resistor is arranged in series with the third semiconductor junction.

By a suitable choice of the components it is possible to obtain a sum current having a substantially zero TC. This sum current can be branched off and duplicated. To this end a first variant is characterised in that said other one of the first and second common terminals is coupled to the first supply terminal via an input branch of a current mirror. The current mirror can now further be provided with output branches for supplying constant and temperature-stable currents. In the present case the currents are referred to the potential of the first supply terminal.

A second variant is characterised in that the differential amplifier comprises an output transistor having a control electrode, a first main electrode forming the output of the differential amplifier, and a second main electrode coupled to an input branch of a current mirror. The output transistor may be a bipolar or unipolar (MOS) transistor. The first main electrode is the emitter/source, which functions as the output of the differential amplifier. However, the current flowing in the collector/drain is substantially equal to the current in the emitter/source. By connecting the collector/drain to a current mirror it is now possible to obtain constant and temperature-stable currents which are related to another supply potential. An alternative solution is characterised in that the differential amplifier comprises an output transistor having a first main electrode coupled to a second supply terminal, a second main electrode forming the output of the differential amplifier, and a control electrode arranged to be coupled to control electrodes of replicas of the output transistor, which replicas have their first main electrodes coupled to the second supply terminal in a manner similar to the first main electrode of the output transistor. In this embodiment the collector/drain of the output transistor forms the output of the differential amplifier. The emitter/source is coupled to the second supply terminal, at option via a series resistor. The provision of scaled or non-scaled replicas of the output transistor again results in a number of constant and temperature-stable currents referred to the potential of the second supply terminal.

However, by an appropriate choice of the components it is also possible to obtain a sum current with a negative TC. This sum current can be passed through a resistor and buffered with a buffer transistor arranged as an emitter follower, which in its turn drives the bases of a number of current source transistors. An embodiment which is suitable for this purpose is characterised in that the output of the differential amplifier is coupled to said one of the first and second common terminals via a fourth resistor, and the reference voltage source further comprises a buffer transistor having a base coupled to the output of the differential amplifier, having an emitter coupled to the first supply terminal via a quiescent current source and to an output terminal for connection of at least one current source transistor having a base coupled to the output terminal, an emitter coupled to the first supply terminal, and a collector for supplying a constant current. The negative TC of the sum current through the fourth resistor compensates for the positive TC of the voltage across the third resistor. The voltage on the base of the buffer transistor, reckoned from the voltage on the first supply terminal, is the sum of two junction voltages, i.e. those of the second and the third semiconductor junction, and of the voltages across the third and the fourth resistor. However, the last-mentioned voltages may be small, i.e. approximately 250 mV together. This means that the voltage on the emitters of the current source transistors to be driven is also approximately 250 mV spaced from the voltage on the first supply terminal. The collector swing of the current source transistors is therefore comparatively large for low supply voltages.

An embodiment which still operates in the case of a 3 V supply and which requires few components is characterised in that the first semiconductor junction is a base-emitter junction of a first transistor having a base, a collector coupled to the first connection terminal, and an emitter connected to the first resistor, and the second semiconductor junction is a base-emitter junction of a diode-connected second transistor having a base coupled to the base of the first transistor, and having a collector coupled to the second connection terminal, and in that the differential amplifier comprises: a fifth resistor and a third transistor having a base and an emitter, which are coupled to the first connection terminal and the first supply terminal, respectively, and having a collector coupled to a second supply terminal via the fifth resistor, the output of the differential amplifier being formed by the collector of the third transistor.

This embodiment can be improved even further and to this end it is characterised in that the fourth resistor is connected to a tapping of the fifth resistor. This provides an additional compensation for supply voltage variations. An increase of the voltages across the second and, if applicable, the fourth resistor is compensated for by an opposite increase of the voltage across the resistor between the tapping and the collector of the third transistor.

The quiescent current source of the buffer transistor may be further characterised in that the quiescent current source comprises a fourth transistor having a base, emitter and collector coupled to the base of the second transistor, the first supply terminal and the emitter of the buffer transistor, respectively. The quiescent current through the buffer transistor is thus related to the current through the second transistor.

BRIEF DESCRIPTION OF THE DRAWINGS

These and other aspects of the invention will now be described and elucidated in greater detail with reference to the accompanying drawings, in which.

In these Figures like elements bear the same reference symbols.

DESCRIPTION OF THE PREFERRED EMBODIMENTS

Figure 1:
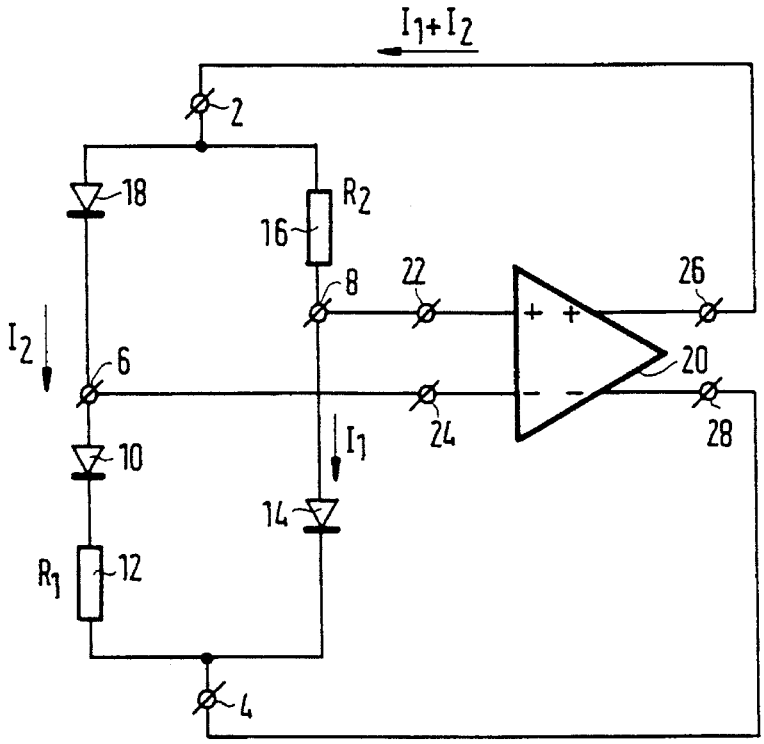
FIG. 1 shows a general circuit diagram of a reference voltage source in accordance with the invention.

FIG. 1 shows the general circuit diagram of a reference voltage source in accordance with the invention. There are provided a first common terminal 2, a second common terminal 4, a first connection terminal 6 and a second connection terminal 8. A first semiconductor junction 10 and a first resistor 12 are connected in series between the first connection terminal 6 and the second common terminal 4. A second semiconductor junction 14 is connected between the second connection terminal 8 and the second common terminal 4. A second resistor 16 is connected between the second connection terminal 8 and the first common terminal 2. A third semiconductor junction 18 is connected between the first connection terminal 6 and the first common terminal 2. Moreover, there is provided a differential amplifier 20 having a non-inverting input 22 and an inverting input 24, one of these inputs being coupled to the first connection terminal 6 and the other input being coupled to the second connection terminal 8, and having a non-inverting output 26 and an inverting output 28, one of these outputs being coupled to the first common terminal 2 and the other output being coupled to the second common terminal 4. A first current $I_1$ flows from the first common terminal 2 to the second common terminal 4 via the second connection terminal 8. A second current $I_2$ flows from the first common terminal 2 to the second common terminal 4 via the first connection terminal 6. The sum current $I_1+I_2$ is supplied to the first common terminal 2 by the non-inverting output 26 of the differential amplifier 20 and is drained from the second common terminal 22 by the inverting output 28. The input current to the non-inverting input 22 and the inverting input 24 may be ignored. The differential amplifier 20 makes the voltage difference between the first connection terminal 6 and the second connection terminal 8 very small. The voltage across the second resistor 16 is then equal to the junction voltage $Vbe_3$ across the third semiconductor junction 18. The current $I_1$ through the second resistor 16 consequently complies with the equation:

$$I_1 = \frac{Vbe_3}{R_2} \tag{1}$$

Here, $R_2$ is the resistance value of the second resistor 16. The current $I_2$ complies with the following equation:

$$I_2 = \frac{V_T}{R_1} \ln\left[\frac{I_1}{I_2} \cdot \frac{A_1}{A_2}\right] \tag{2}$$

Here, $V_T$ is the thermal potential (kT/q), $R_1$ is the resistance value of the first resistor 12, $A_1$ is the area of the first semiconductor junction 10 and $A_2$ is the area of the second semiconductor junction 14. Equation (2) is known per se. For further details reference is made to, for example, IEEE Journal of Solid States Circuits, Vol. SC-8, No. 3, June 1973, pp. 222–226, "A Precision Reference Voltage Source".

Figure 2:
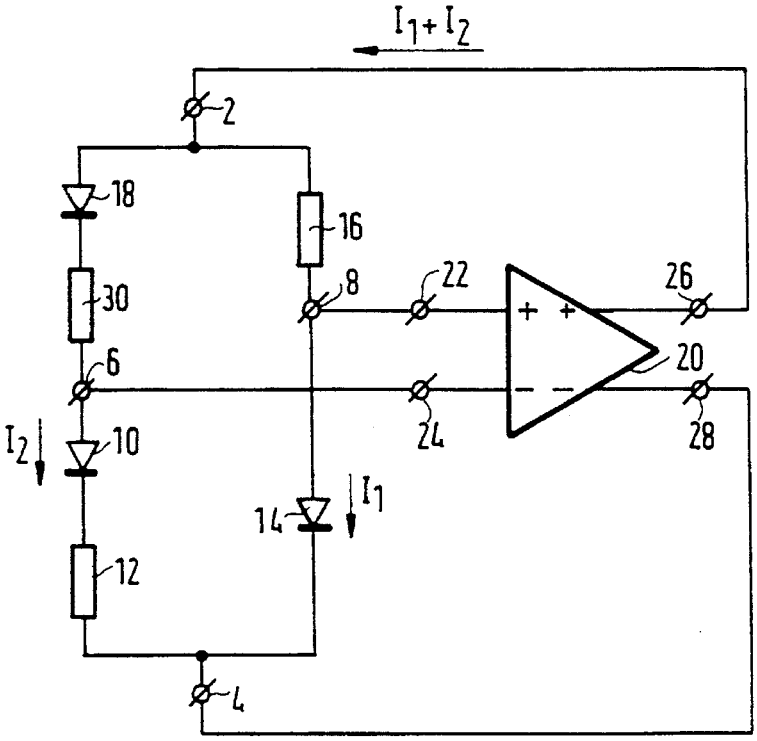
FIG. 2 shows a general circuit diagram of a reference voltage source in accordance with the invention.

Equation (1) may be regarded to express the effect of a first current mirror having a current transfer with a negative temperature coefficient (TC), for the junction voltage $Vbe_3$, as is known, has a negative TC. Since $V_T$=kT/q is proportional to the absolute temperature, the ratio $I_2/I_1$ has a positive TC. If the temperature T now increases the junction voltage $Vbe_3$ and hence the first current $I_1$ will decrease. However, the decrease of the first current $I_1$ is compensated by an increase in the second current $I_2$ owing to the positive TC in the ratio $I_2/I_1$. Thus, the sum current $I_1+I_2$ can have a TC which is substantially zero. It is then found that the area $A_1$ should be approximately eight times as large as the area $A_2$ in order to enable the decrease of the first current $I_1$ to be compensated for by the increase of the second current $I_2$. By arranging, as shown in FIG. 2, a third resistor 30 in series with the third semiconductor junction 18 it is possible to reduce the comparatively large negative TC of the first current mirror. The second current $I_2$ with a positive TC flows through the third resistor 30 and produces across this third resistor 30 a voltage drop which also has a positive TC. The positive TC of this voltage drop reduces the negative TC of the junction voltage $Vbe_3$.

Figure 3:
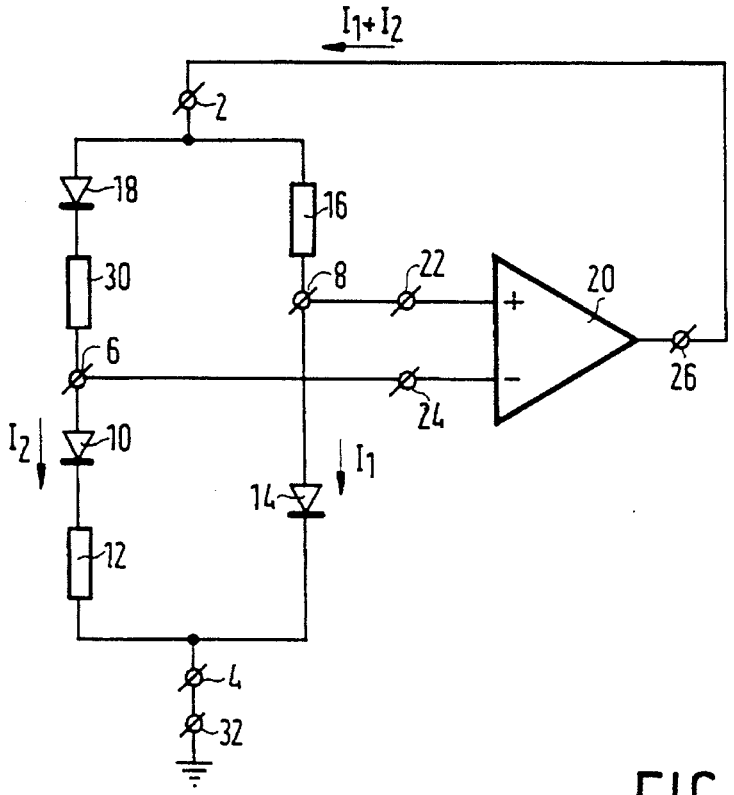
FIG. 3 shows an embodiment of a reference voltage source in accordance with the invention.
Figure 4:
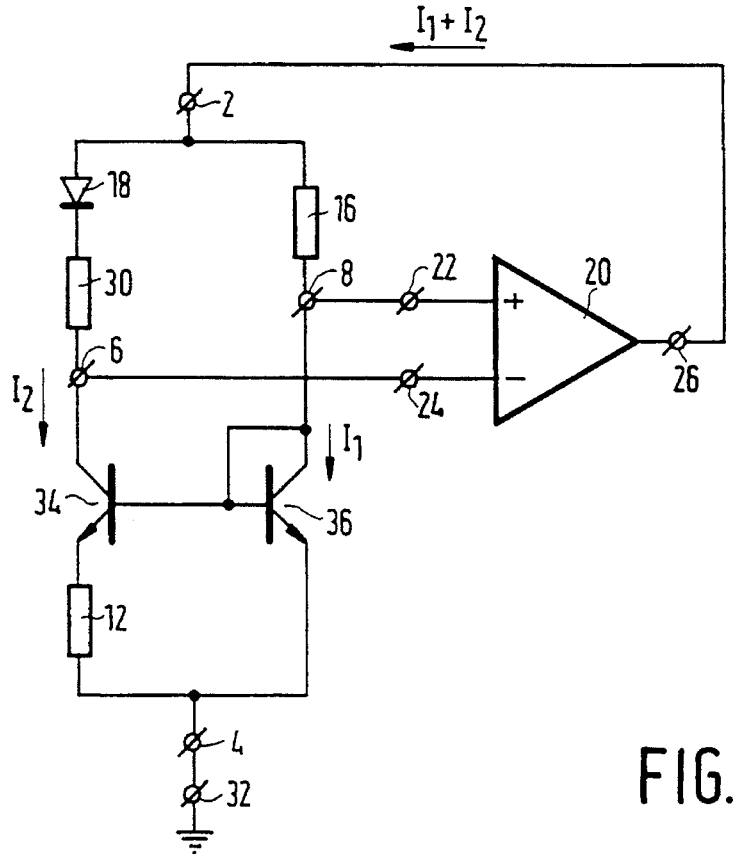
FIG. 4 shows an embodiment of a reference voltage source in accordance with the invention.
Figure 5:
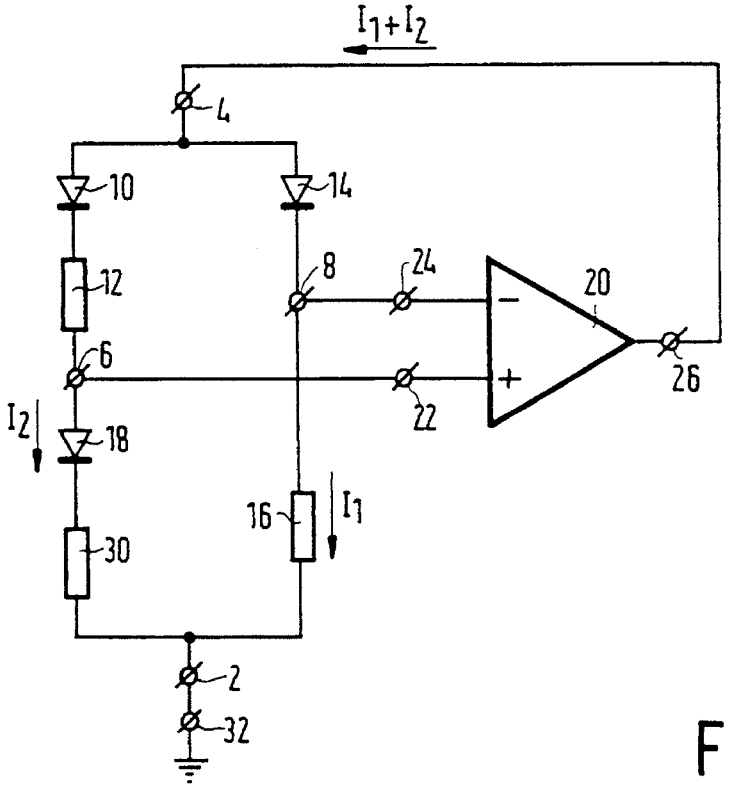
FIG. 5 shows an embodiment of a reference voltage source in accordance with the invention.

The basic operation of the arrangement shown in FIG. 2 does not change if one of the common terminals 2 and 4 is connected to a fixed voltage and, in addition, the relevant output of the differential amplifier 20 is dispensed with. FIGS. 3 to 6 show a number of variants. In FIG. 3 the second common terminal 4 is connected to a first supply terminal 32, which is assumed to be ground, the non-inverting output 26 is connected to the first common terminal 2, and the inverting output 28 is dispensed with. In FIG. 5 it is not the second but the first common terminal 2 which is connected to the first supply terminal 32. The non-inverting output 26 is now connected to the second common terminal 4 and the non-inverting input 22 and the inverting input 24 are connected the other way around.

Figure 6:
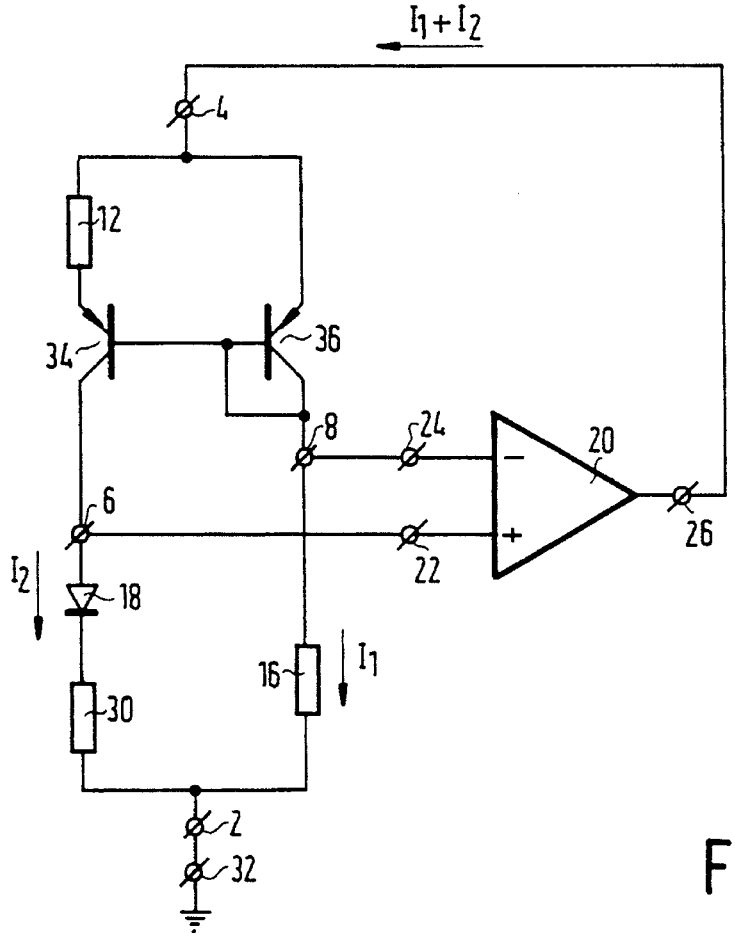
FIG. 6 shows an embodiment of a reference voltage source in accordance with the invention.

The first semiconductor junction 10, the second semiconductor junction 14 and the third semiconductor junction 18 are shown as diodes but they may also be formed by transistors each having an interconnected collector and base. The effect of the first semiconductor junction 10, the first resistor 12 and the second semiconductor junction 14 can also be obtained in an alternative manner. FIG. 4 shows such an alternative for the arrangement of FIG. 3. In FIG. 4 the first semiconductor junction 10 is the base-emitter junction of a first transistor 34 whose collector is coupled to the first connection terminal 6 and whose emitter is connected to the first resistor 12. The second semiconductor junction 14 is the base-emitter junction of a diode-connected second transistor 36 whose base is connected to the base of the first transistor 34 and whose collector is coupled to the second connection terminal 8. FIG. 6 shows a similar alternative for the arrangement in FIG. 5.

Figure 7:
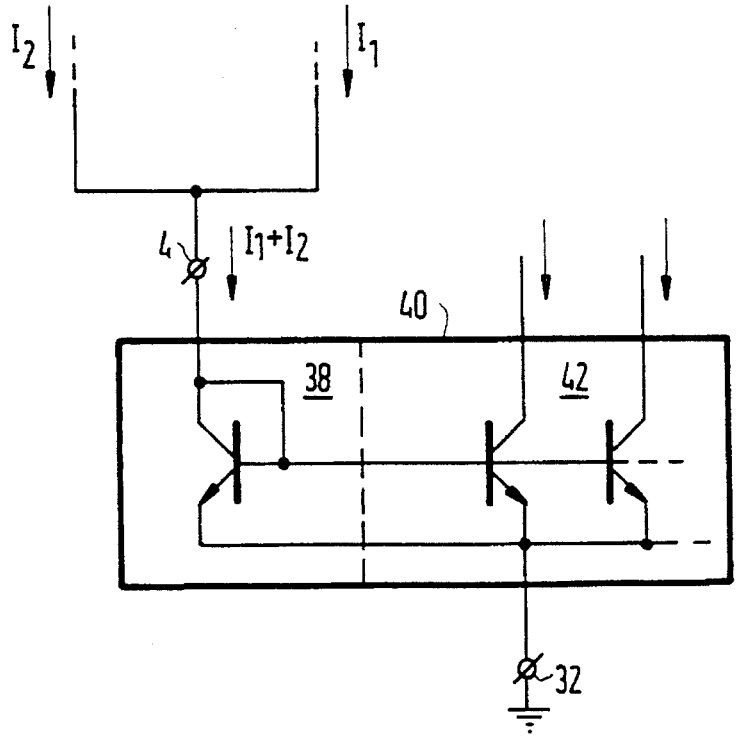
FIG. 7 shows a detail of an embodiment of a reference voltage source in accordance with the invention.

The sum current $I_1+I_2$ with a TC which is substantially zero flows through the first common terminal 2 and the second common terminal 4. FIG. 7 shows a second example of how the sum current can be used. The first common terminal 4 of the arrangement in FIG. 3 or 4 is connected to the first supply terminal 32 via an input branch 38 of a current mirror 40. The current mirror 40 comprises a number of current source transistors 42 whose base-emitter junctions are arranged in parallel with the base-emitter junction of a diode-connected transistor in the input branch 38. The current source transistors 42 supply currents with the same TC as the sum current $I_1+I_2$. Obviously, a similar coupling-out method by means of a current mirror can be used in the circuit arrangements shown in FIGS. 5 and 6.

Figure 8:
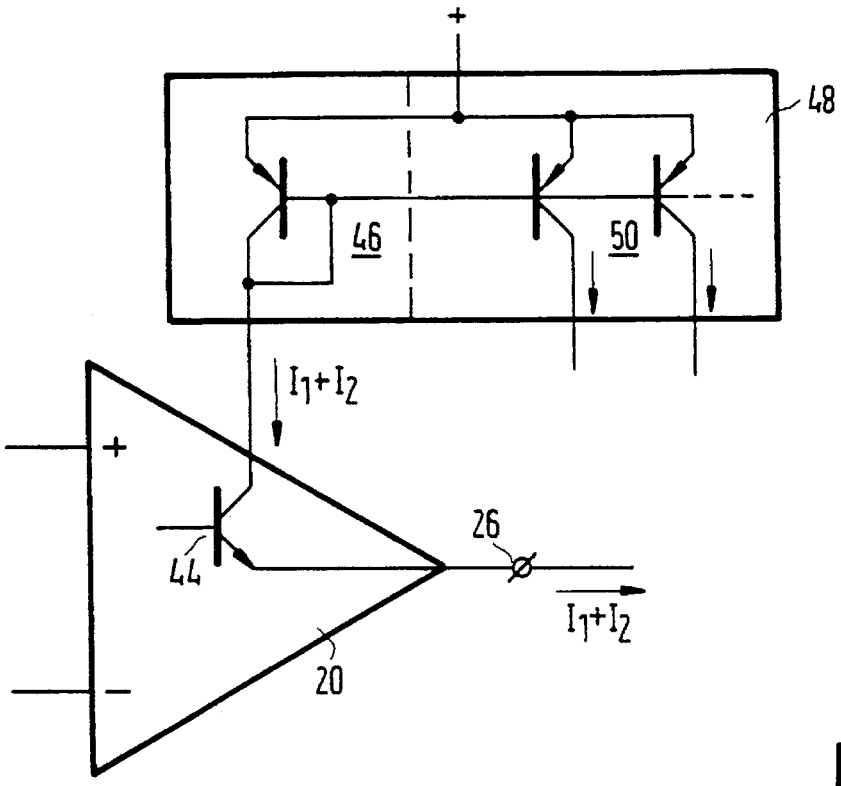
FIG. 8 shows a detail of an embodiment of a reference voltage source in accordance with the invention.

FIG. 8 shows another coupling-out method. The differential amplifier 20 has an output transistor 44 having its emitter connected to the non-inverting output 26. The collector of the output transistor 44 is connected to the input branch 46 of a current mirror 48, which for the rest may be similar to the current mirror 40 shown in FIG. 7. The sum current $I_1+I_2$ in the emitter of the output transistor 44 flows almost completely through the collector, so that the current source transistors 50 of the current mirror 48 supply currents with the same TC as the sum current. The output transistor 44 may alternatively be a MOS transistor. The same applies to the transistors in the current mirror 40 in FIG. 7 and the current mirror 48 in FIG. 8.

Figure 9:
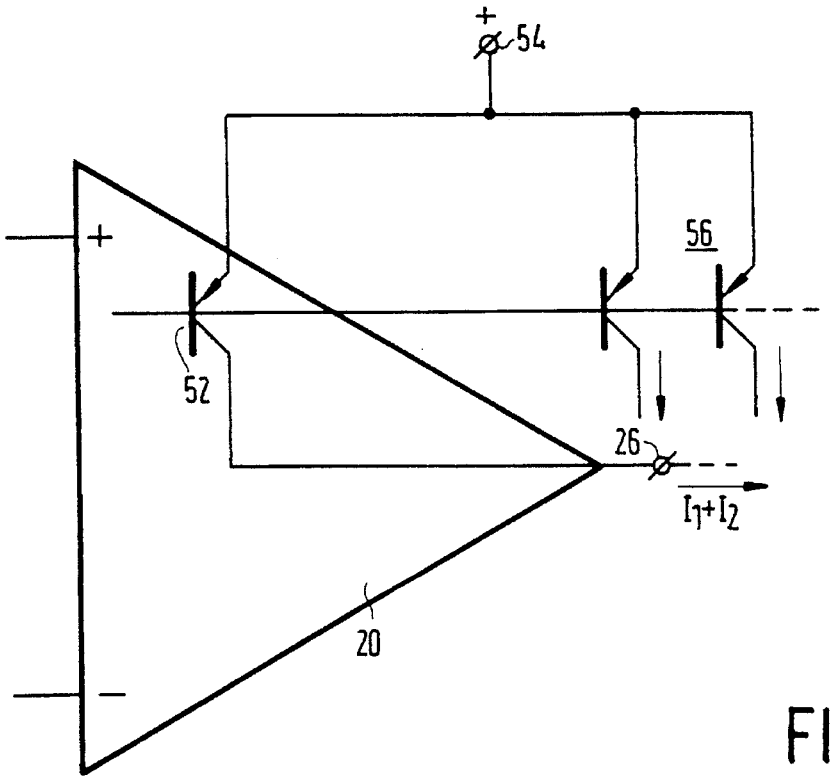
FIG. 9 shows a detail of an embodiment of a reference voltage source in accordance with the invention.

FIG. 9 shows a third coupling-out method. The differential amplifier 20 now again has an output transistor 52 but now the collector is connected to the non-inverting output 26. The emitter is connected to a second supply terminal 54. The base-emitter junctions of replica transistors 56 are arranged in parallel with the base-emitter junction of the output transistor 52. The replica transistors 56 supply collector currents with a TC equal to the TC of the sum current $I_1+I_2$. In the present case the output transistor 52 and the replica transistors 56 may also be MOS transistors.

Figure 10:
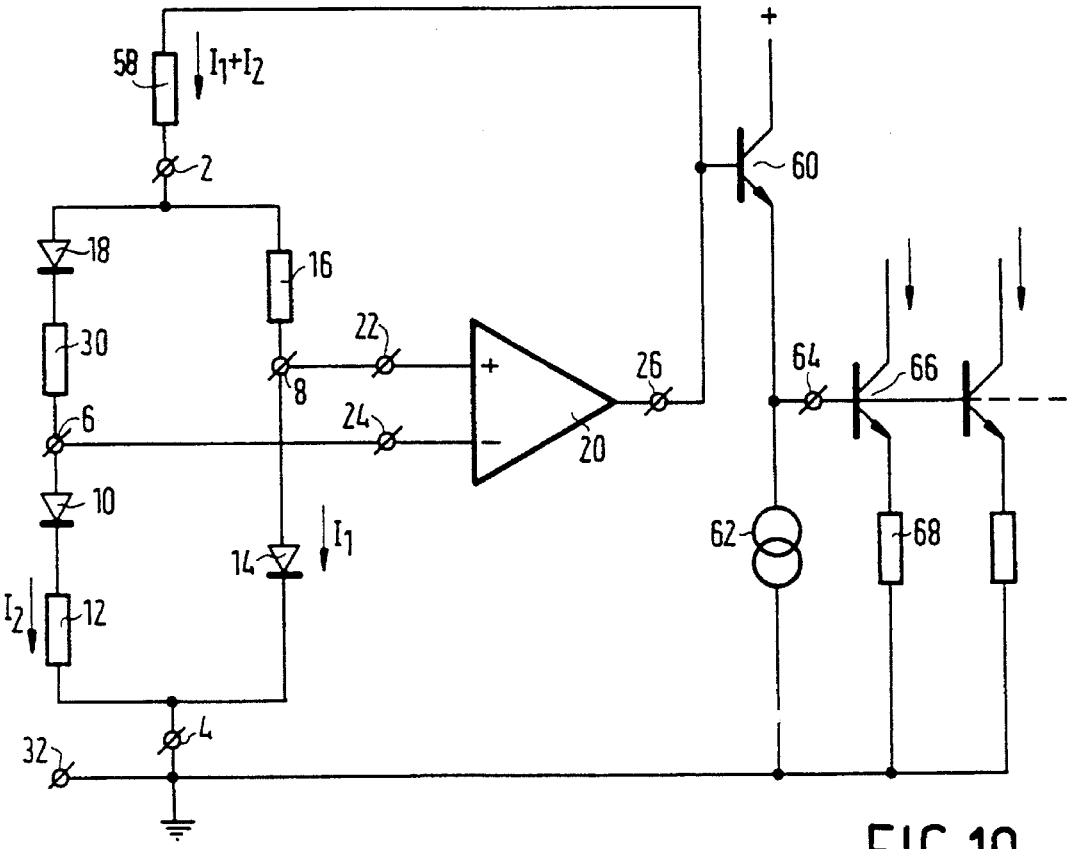
FIG. 10 shows an embodiment of a reference voltage source in accordance with the invention.

Until now the object has been to obtain a sum current $I_1+I_2$ with a TC which is substantially zero. The decrease of the first current $I_t$ is then compensated by an increase of the second current $I_2$ owing to the positive TC in the ratio $I_2/I_1$. Thus, the sum current $I_1+I_2$ can be given a TC which is substantially zero. However, it is also possible to aim deliberately at less than full compensation, in which case the sum current will have a TC which is slightly negative. FIG. 10 shows a circuit arrangement where this is the case. The circuit arrangement is based on a variant of FIG. 3 but the variants shown in FIGS. 4, 5 and 6 are equally suitable. The non-inverting output 26 of the differential amplifier 20 is now connected to the first common terminal 2 via a fourth resistor 58. There is also provided a buffer transistor 60 having its base connected to the non-inverting output 26 and having its emitter connected to the first supply terminal 32 via a quiescent-current source 62 and to a connection terminal 64 for the connection of the bases of a plurality of current source transistors 66, whose emitters are connected to the first supply terminal 32 by respective series resistors 68. Starting from the first supply terminal 32 the voltage on the base of the buffer transistor 60 is now found to be equal to the sum of the junction voltage $Vbe_{14}$ of the second semiconductor junction 14, the voltage drop $Ur_{30}$ across the third resistor 30, the junction voltage $Vbe_{18}$ of the third semiconductor junction 18 and the voltage drop $Ur_{58}$ across the fourth resistor 58. However, the voltage on the base of the buffer transistor 60 is also equal to the sum of the voltage $Ur_{68}$ across the series resistor 68, the junction voltage $Vbe_{66}$ of the current source transistor 66 and the junction voltage $Vbe_{60}$ of the buffer transistor 60. In a first approximation the voltage $Ur_{68}$ across the series resistor 68 is equal to the sum of the voltage $Ur_{30}$ across the third resistor 30 and the voltage $Ur_{58}$ across the fourth resistor 58. The current $I_2$, which as already stated has a positive TC, flows through the third resistor 30. The sum current $I_1+I_2$, which has a negative TC, flows through the fourth resistor 58. The sum voltage across the third resistor 30 and the fourth resistor 58 can thus have a TC which is substantially zero. This voltage appears across the series resistor 68 of the current source transistors 66, which consequently supply a collector current which is temperature-stable.

Figure 11:
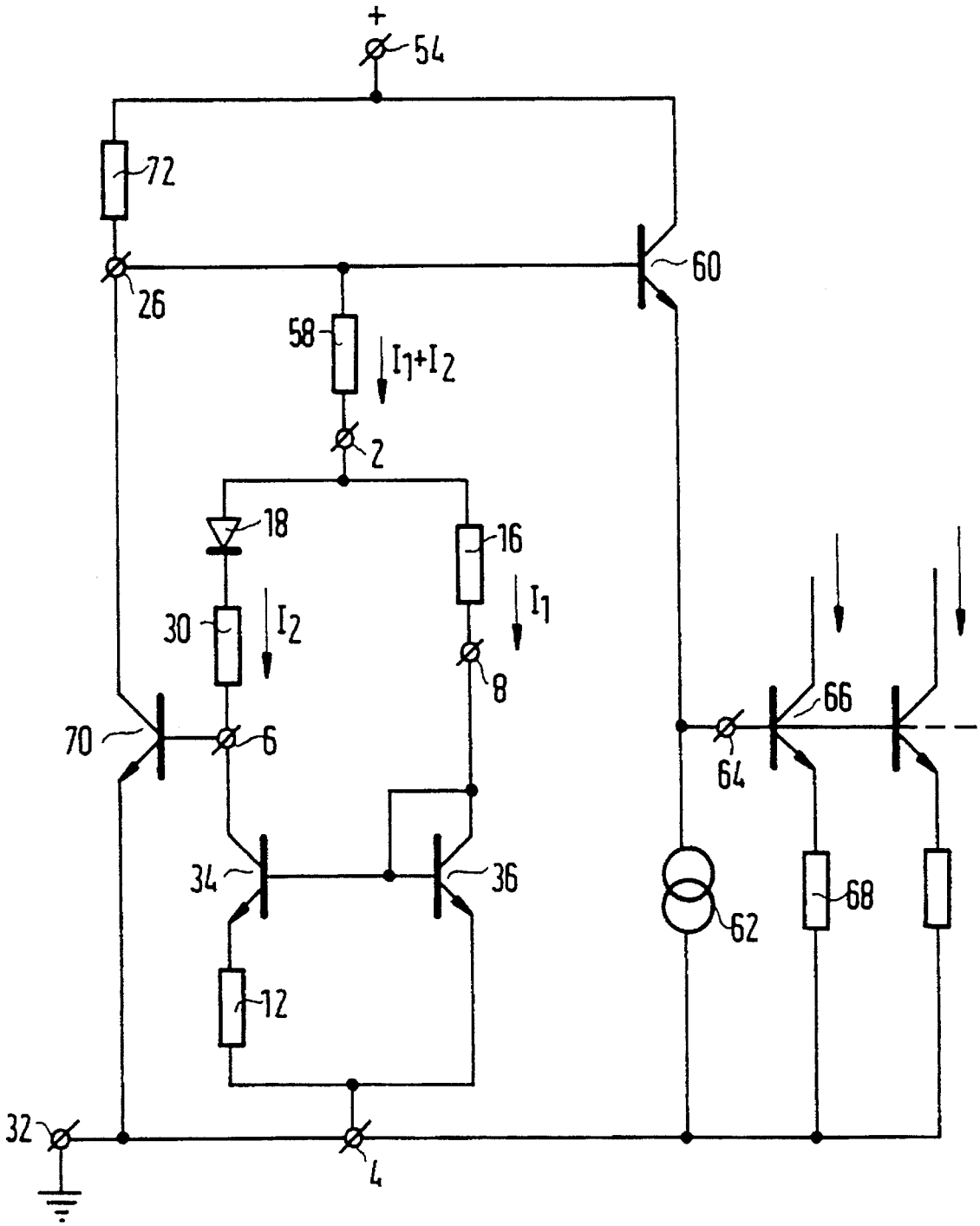
FIG. 11 shows an embodiment of a reference voltage source in accordance with the invention.

The differential amplifier 20 in FIG. 10 can be simplified considerably when it is based on the variant shown in FIG. 4. The result is shown in FIG. 11. The differential amplifier 20 now comprises a third transistor 70, whose emitter, base and collector are connected to the first supply terminal 32, the first connection terminal 6 and the non-inverting output 26, respectively. The non-inverting output 26 is connected to the second supply terminal 54 via a fifth resistor 72. The base of the third transistor 70 functions as the inverting input. The emitter of the third transistor 70 functions as the non-inverting input, which is coupled to the second connection terminal 8 via the base-emitter junction of the second transistor 36 in order to compensate for the base-emitter offset voltage of the third transistor 70. This circuit arrangement still operates at low supply voltages to approximately 3 V. The required total voltage is two junction voltages, i.e. those of the buffer transistor 60 and the current source transistor 66, plus the voltage across the series resistor 68, which can be selected freely and is, for example, 250 mV, and the voltage across the fifth resistor 72.

Figure 12:
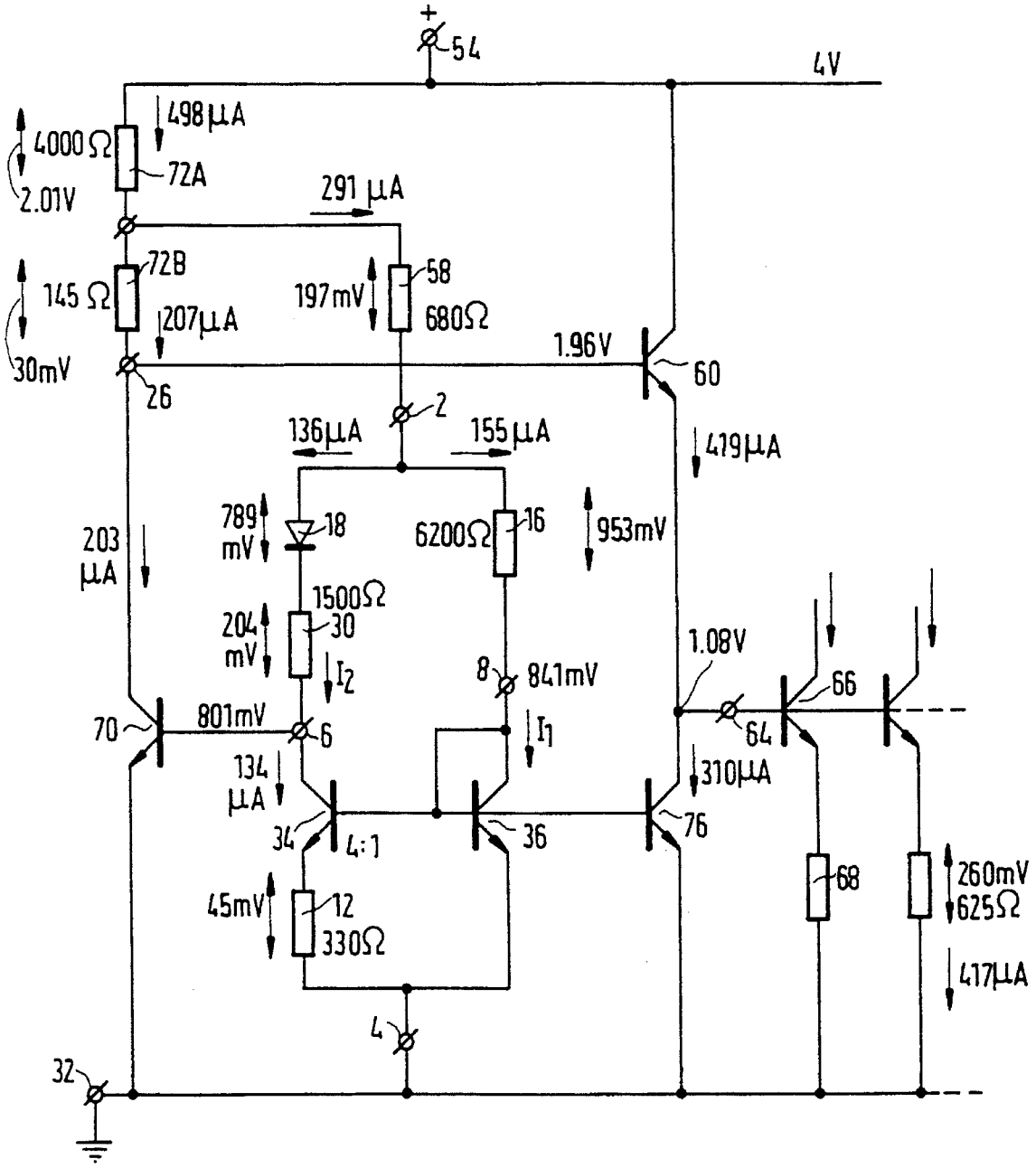
FIG. 12 shows an embodiment of a reference voltage source in accordance with the invention.

In FIG. 12 the fifth resistor 72 comprises two parts with a tapping 74, to which the fourth resistor 58 is connected. The part between the second supply terminal and the tapping is referenced 72A and the other part is referenced 72B. This provides an additional compensation for supply voltage variations. An increase of the voltages across the second resistor 16 and, if applicable, the fourth resistor 58, caused by an increasing supply voltage is compensated by an oppositely directed increase of the voltage across the resistor between the rapping 74 and the non-inverting output 26. The quiescent current source 62 of FIG. 11 comprises in FIG. 12 a fourth transistor 76 whose base, emitter and collector are connected to the base of the second transistor 36, the first supply terminal 32 and the emitter of the buffer transistor 60, respectively. The first current $I_1$ is mirrored and is used as the quiescent current for the buffer transistor 60.

FIG. 12 by way of example gives the nominal currents, voltages and resistance values for a supply voltage of 4 V at 27 degrees Celsius. The following values are given:

voltage on the second supply terminal 54:4 V relative to ground;

resistor 72A: 4000 Ω;

voltage across resistor 72A: 2.01 V;

current through resistor 72A: 498 μA;

resistor 72B: 145 Ω;

voltage across resistor 72B: 30 mV;

current through resistor 72B: 207 μA;

resistor 58: 680 Ω;

voltage across resistor 58: 197 mV;

current through resistor 58: 291 μA;

resistor 16: 6200 Ω;

voltage across resistor 16: 953 mV;

current through resistor 16: 155 μA;

resistor 30: 1500 Ω;

voltage across resistor 30: 204 mV;

current through resistor 30: 136 μA;

resistor 12: 330 Ω;

voltage across resistor 12: 45 mV;

resistor 68: 625 Ω;

voltage across resistor 68: 260 mV;

current through resistor 68:417 μA;

base voltage of transistor 60: 1.96 V relative to ground;

emitter current of transistor 60: 419 μA;

emitter voltage of transistor 60: 1.08 V relative to ground;

base voltage of transistors 34, 36 and 76: 841 mV relative to ground;

collector current of transistor 76: 310 μA;

collector current of transistor 34: 134 μA;

base voltage of transistor 70: 801 mV relative to ground;

collector current of transistor 70: 203 μA;

ratio between emitter area of transistor 34 and emitter area of transistor 36: 4.

In all of the circuit arrangements shown herein transistors of an opposite conductivity type may be used. In principle, mirrors 40 and 48 may be of any known type.

I claim:

1. A reference voltage source for driving a current source, which reference voltage source comprises:

a first common terminal, a second common terminal, a first connection terminal, and a second connection terminal;

an impedance connected between the first common terminal and the first connection terminal;

a first semiconductor junction and a first resistor connected in series between the first connection terminal and the second common terminal;

a second resistor connected between the first common terminal and the second connection terminal;

a second semiconductor junction connected between the second connection terminal and the second common terminal;

a differential amplifier having an output and having an inverting input and a non-inverting input, one of said inputs being coupled to the first connection terminal and the other input being coupled to the second connection terminal; and one of the first and second common terminals being coupled to the output of the differential amplifier and the other common terminal being coupled to a first supply terminal, wherein the impedance comprises a third semiconductor junction.

2. A reference voltage source as claimed in claim 1, further comprising a third resistor connected in series with the third semiconductor junction.

3. A reference voltage source as claimed in claim 1 wherein said other one of the first and second common terminals is coupled to the first supply terminal via an input branch of a current mirror.

4. A reference voltage source as claimed in claim 3, wherein the differential amplifier comprises an output transistor having a control electrode, a first main electrode forming the output of the differential amplifier, and a second main electrode coupled to the input branch of the current mirror.

5. A reference voltage source as claimed in claim 1, wherein the differential amplifier comprises an output transistor having a first main electrode coupled to a second supply terminal, a second main electrode forming the output of the differential amplifier, and a control electrode coupled to control electrodes of transistor replicas of the output transistor, which transistor replicas have their first main electrodes coupled to the second supply terminal in a manner similar to the first main electrode of the output transistor.

6. A reference voltage source as claimed in claim 1 wherein the output of the differential amplifier is coupled to said one of the first and second common terminals via a fourth resistor a buffer transistor having a base coupled to the output of the differential amplifier, having an emitter coupled to the first supply terminal via a quiescent current source and to an output terminal, and at least one current source transistor having a base coupled to the output terminal, an emitter coupled to the first supply terminal, and a collector for supplying a constant current.

7. A reference voltage source as claimed in claim 6, wherein the first semiconductor junction comprises a base-emitter junction of a first transistor having a base, a collector coupled to the first connection terminal, and an emitter connected to the first resistor, and the second semiconductor junction comprises a base-emitter junction of a diode-connected second transistor having a base coupled to the base of the first transistor and having a collector coupled to the second connection terminal.

8. A reference voltage source as claimed in claim 7, wherein the differential amplifier comprises: a fifth resistor and a third transistor having a base and an emitter coupled to the first connection terminal and the first supply terminal, respectively, and having a collector coupled to a second supply terminal via the fifth resistor, wherein the output of the differential amplifier comprises the collector of the third transistor.

9. A reference voltage source as claimed in claim 8, wherein the fourth resistor is connected to a tapping of the fifth resistor.

10. A reference voltage source as claimed in claim 7, wherein the quiescent current source comprises a fourth transistor having a base, emitter and collector coupled to the base of the second transistor, the first supply terminal and the emitter of the buffer transistor, respectively.

11. A reference voltage source as claimed in claim 2, wherein said other one of the first and second common terminals is coupled to the first supply terminal via an input branch of a current mirror.

12. A reference voltage source as claimed in claim 1, wherein the differential amplifier comprises an output transistor having a control electrode, a first main electrode forming the output of the differential amplifier, and a second main electrode coupled to an input branch of a current mirror.

13. A reference voltage source as claimed in claim 3, wherein the differential amplifier comprises an output transistor having a first main electrode coupled to a second supply terminal, a second main electrode forming the output of the differential amplifier, and a control electrode coupled to control electrodes of transistor replicas of the output transistor, which transistor replicas have their first main electrodes coupled to the second supply terminal in a manner similar to the first main electrode of the output transistor.

14. A reference voltage source as claimed in claim 2 wherein the output of the differential amplifier is coupled to said one of the first and second common terminals via a fourth resistor, a buffer transistor having a base coupled to the output of the differential amplifier, having an emitter coupled to the first supply terminal via a quiescent current source and to an output terminal, and at least one current source transistor having a base coupled to the output terminal, an emitter coupled to the first supply terminal, and a collector for supplying a constant current.

15. A reference voltage source as claimed in claim 14, wherein the first semiconductor junction comprises a base-emitter junction of a first transistor having a base, a collector coupled to the first connection terminal, and an emitter connected to the first resistor, and the second semiconductor junction comprises a base-emitter junction of a diode-connected second transistor having a base coupled to the base of the first transistor, and having a collector coupled to the second connection terminal.

16. A reference voltage source as claimed in claim 15, wherein the differential amplifier comprises: a fifth resistor, and a third transistor having a base and an emitter coupled to the first connection terminal and the first supply terminal, respectively, and having a collector coupled to a second supply terminal via the fifth resistor, wherein the output of the differential amplifier comprises the collector of the third transistor.

17. A reference voltage source as claimed in claim 1 further comprising a third resistor connected in series circuit with the third semiconductor junction between said first common terminal and said first connection terminal.

18. A reference voltage source comprising:

first and second common terminals, a bridge circuit comprising first and second branch circuits coupled between said first and second common terminals, wherein said first branch circuit includes, a first resistor, a first semiconductor junction device and a third semiconductor junction device connected in a first series circuit between said second and first common terminals in the order named, a second semiconductor junction device and a second resistor connected in a second series circuit between said second and first common terminals in the order named, a differential amplifier having first and second inputs coupled to first and second nodes in the first and second series circuits, respectively, and means coupling an output of the differential amplifier to one of said first and second common terminals thereby to supply a temperature stable sum current to the bridge circuit.

19. A reference voltage source as claimed in claim 18 further comprising a current mirror coupled to the reference voltage source so that a current proportional to the sum current flows in an input branch of the current mirror, and means coupling an output branch of the current mirror to at least one current source transistor which provides a temperature stable current.

* * * * *